US006105936A

United States Patent [19]

Malek

[11] Patent Number: 6,105,936

[45] Date of Patent: Aug. 22, 2000

[54] STAPLE REMOVER

[76] Inventor: Shahin S. Malek, 307 Shaker Run, Albany, N.Y. 12205

[21] Appl. No.: 09/242,886

[22] PCT Filed: Sep. 4, 1997

[86] PCT No.: PCT/US97/15563

§ 371 Date: Feb. 25, 1999

§ 102(e) Date: Feb. 25, 1999

[87] PCT Pub. No.: WO98/09775

PCT Pub. Date: Mar. 12, 1998

[51] Int. Cl.[7] ..... B25C 11/00

[52] U.S. Cl. ..... 254/28

[58] Field of Search ..... 254/28; 30/162; 227/63; D8/48; 29/268

[56] References Cited

U.S. PATENT DOCUMENTS 2,539,171 1/1951 Yerkes ..... 254/28
2,662,727 12/1953 Yerkes ..... 254/28
3,345,036 10/1967 Cooke ..... 254/28
4,054,263 10/1977 Delia ..... 254/28

*Primary Examiner*—Robert C. Watson
*Attorney, Agent, or Firm*—Jay R. Yablon

[57] ABSTRACT

A device for removing staples from papers, cloth, or other material without tearing or mutilating the material. The device utilizes a heel of palm to finger gripping action to facilitate a more natural action for removing staples. Staples are extracted by way of a jaw which opposes a wedge-shaped piece (16) to an abutting plate piece (21), which straightens the staple while simultaneously pulling it out of the paper in a perpendicular direction. The wedge-shaped piece (16) includes a portion where its width and thickness increase to dimensions wherein the sum of the width plus twice the thickness exceeds the total length of the three sides of the staples being removed, thus facilitating complete extraction.

25 Claims, 8 Drawing Sheets

STAPLE REMOVER

FIELD OF THE INVENTION

The present invention generally relates to devices for removing staples. More particularly, the present invention relates to a device for removing staples from paper, cloth, or other material without tearing the material. Also disclosed are several embodiments for manufacturing said staple removing device, including a low-cost unibody method.

BACKGROUND OF THE INVENTION

1. Technical Field

Due to the common use of staples as fasteners, staple removers may be found in almost any office and used in many other applications, such as interior design, fabric production and tailoring, etc. For example, many times staples must be removed to allow papers to be individually copied or to insert an edited form or page. Whatever the reason for wanting to remove a staple from papers, cloth, or other material, it is desirable to do so without tearing or mutilating the material being held together or in place.

Pulling staples manually from materials such as sheet papers is not only extremely inconvenient, but can rarely be accomplished without tearing or mutilation of the stapled material. Thus, various devices have been invented to facilitate easier removal of staples.

Most staple removers require further pulling of the staple after the remover has engaged the staple. Thus, use of these devices often results in tearing of the stapled material.

A further problem with many staple removers is their small size and the manner of gripping them for use. Since many staple removers utilize either a "plier-type" gripping action or a "thumb to finger" action the user must pick-up the stapled material, such as papers, in order to achieve a comfortable angle for use of the staple remover. Furthermore, these types of grips naturally facilitate the tendency of users to pull the remover away from the material, thus increasing the chance of tearing.

2. Background Art

Typical staple remover devices for removing staples from paper are disclosed in U.S. Pat. No. 1,922,681 to Heise, U.S. Pat. No. 2,678,575 to Marano, U.S. Pat. No. 2,431,922 to Curtiss, U.S. Pat. No. 2,662,727 to Yerkes, and in U.K. Patent No. 862,468 to Balma et al. and Italian Patent No. 1,220,438 to Balma, et al.

The staple remover disclosed by Heise (U.S. Pat. No. 1,922,681) utilizes two hinged members with a pair of jaws on one end and a pair of handles on the other. This device utilizes a thin blade and a prong engaging portion to pull the staple from the pages. Thus, the staple is dragged by the engaging portion across the length of the blade as it is removed. Although this may decrease mutilation of papers resulting from manual extraction of staples, it may not do so adequately since the staple is extracted at an angle rather than being lifted out in a perpendicular direction.

U.S. Pat. No. 2,678,575 to Marano reveals a plier-type implement with a pair of elongated members secured together at one end, and normally divergent at their other ends. This device, like Heise, utilizes a thin blade opposed to a prong engaging portion to pull the staple from the pages, and presents roughly the same difficulties. Since the blade is thin, the staple is straightened by pulling it across an abutment at an angle, thus increasing the likelihood of tearing.

The staple remover disclosed by Curtiss (U.S. Pat. No. 2,431,922) involves two elongated arms pivotally attached at one end and normally divergent at their other ends due to the bias created by the free ends of a spring located about the pivot. This device removes a staple by engaging the top portion of the staple with notches and flanges on the lower arm, and then utilizing a thin blade and flanges on the upper arm to pull the staple while simultaneously straightening its legs.

U.K. Patent No. 862,468 to Balma, et al. discloses a plier-like device for detaching metallic staples. (See also Italian Patent 1,220,438 to Balma, et al.) This device utilizes a tapered tongue-like projection of substantially triangular configuration which may be tapered with respect to its width and with respect to its thickness attached to one side of the jaws, and used an abutting means on the other side of the jaws to extract the staple. It extracts staples by driving the tapered-tongue like projection underneath the top portion of a staple with an abutting means when the handles of the device are squeezed together.

The staple remover disclosed by Yerkes (U.S. Pat. No. 2,662,727) has a plate which is parallel to the front surface of a wedge-shaped piece, which results in the staple being pulled by both the wedge-shaped piece and the plate. Indeed, the staple being pulled by both pieces is a common cause of tearing in many staple removers.

All of these devices are operated horizontally by gripping their handles with the thumb on top and the fingers underneath in a grip similar to that used in operating pliers or scissors. The Curtiss device could be operated vertically with a heel of the palm to finger grip, but is not designed to comfortably accommodate such use.

This plier-type grip is less comfortable than a heel of the palm to finger grip when operating a staple remover in a vertical position. Furthermore, operators are more likely to pull on the staple remover device when operating a device horizontally using a plier-type grip than when operating a device vertically using a heel of the palm to finger grip. If a smaller staple remover is desired, such as one that utilizes the thumb on one side and the index and middle fingers on the other side, It would be desirable to incorporate a design that continues to prevent pulling or tearing of the material.

Therefore, a need exists for a staple removing device that completely removes the staple without requiring additional pulling away from the paper, cloth, or other material after the device engages the staple, and which will remove the staple without tearing or mutilating the paper, cloth, or other material. Also, there is a need for a staple remover that may be more comfortably and naturally used, and that minimizes the tendency of the user to pull the remover away from the paper prior to complete extraction of the staple. The aforementioned art is hereby incorporated by reference.

OBJECTS OF THE INVENTION

It is therefore an object of the present invention to have a series of depressions on the upper arm designed to facilitate more comfortable and more efficient removal of staples by allowing the staple remover to be operated in a vertical rather than a horizontal position.

It is therefore a further advantage of the present invention to provide a finger guard whereby the fingers of the user are protected while holding the staple remover.

It is therefore a further advantage of the present invention to provide a wedge versus abutment jaw which includes a wedge-shaped piece where the sum of lengths of the top three sides at its thickest point exceeds the length of the three sides of a standard staple.

It is a further advantage of this invention to provide a staple remover which includes a geometry to remove a staple without tearing the paper, wherein the staple is entirely removed from the paper by a wedge-shaped piece having an arc thereon. This allows the remover to slide easily under the staple.

SUMMARY OF THE INVENTION

The present invention addresses the need for a staple remover that minimizes the tendency to pull the staple away from the paper before it has been completely straightened. It also minimizes tearing of the stapled papers when the staple is extracted.

The present invention provides, in its first aspect, a staple remover device utilizing two arms pivotally attached to each other at their ends. It further provides a wedge-shaped piece where sum of lengths of three sides at its thickest point exceeds the length of the three sides of a standard staple (22 millimeters), thus straightening and removing staples completely. It also provides a finger grip and a finger guard which facilitate comfortable and efficient use of the device.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

Figure 1:
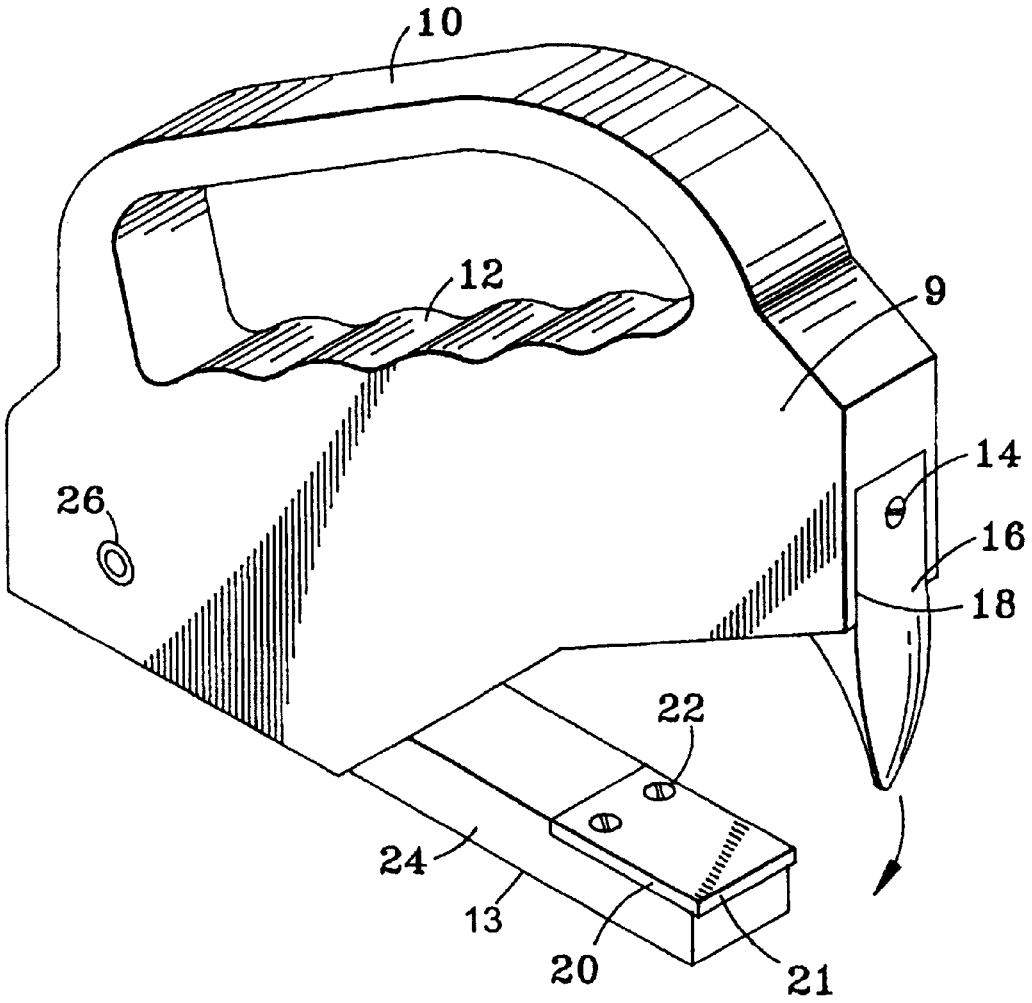
FIG. 1 is a side perspective view of the first preferred embodiment.
Figure 10A:
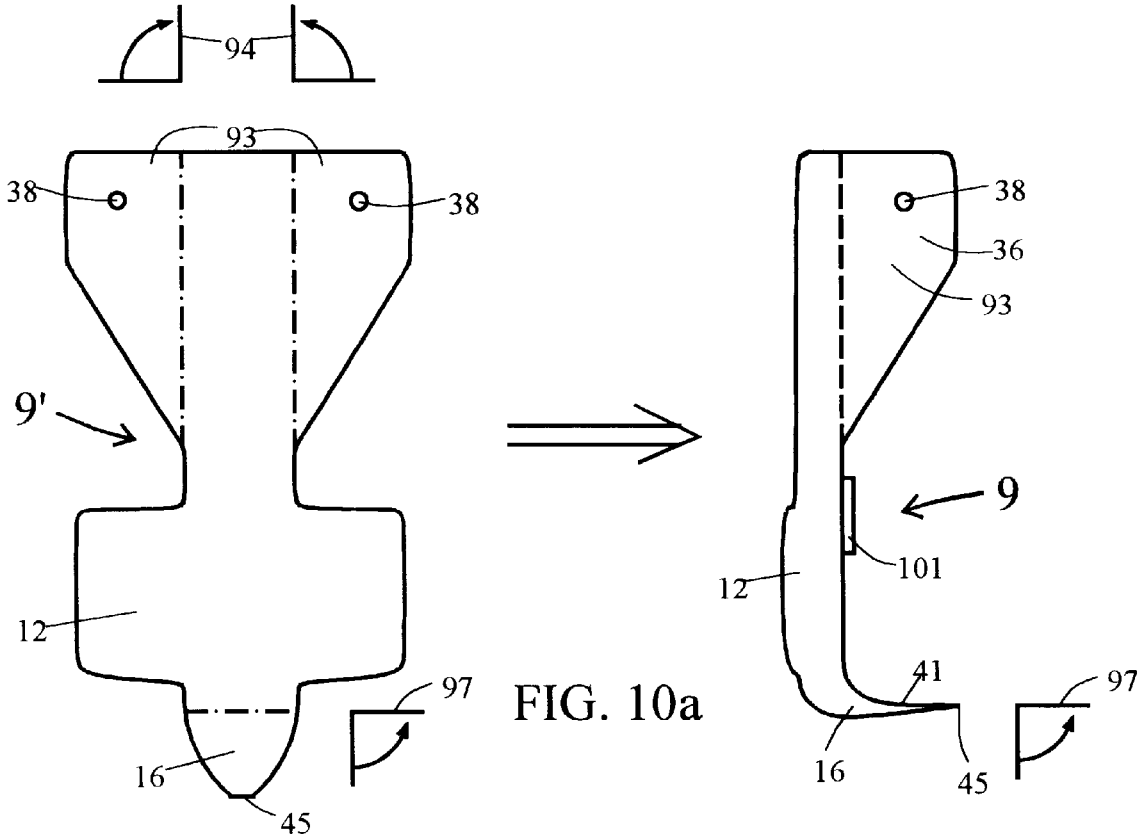
FIG. 10 illustrates a unibody method for fabricating the arms and operational components of this device.
Figure 10B:
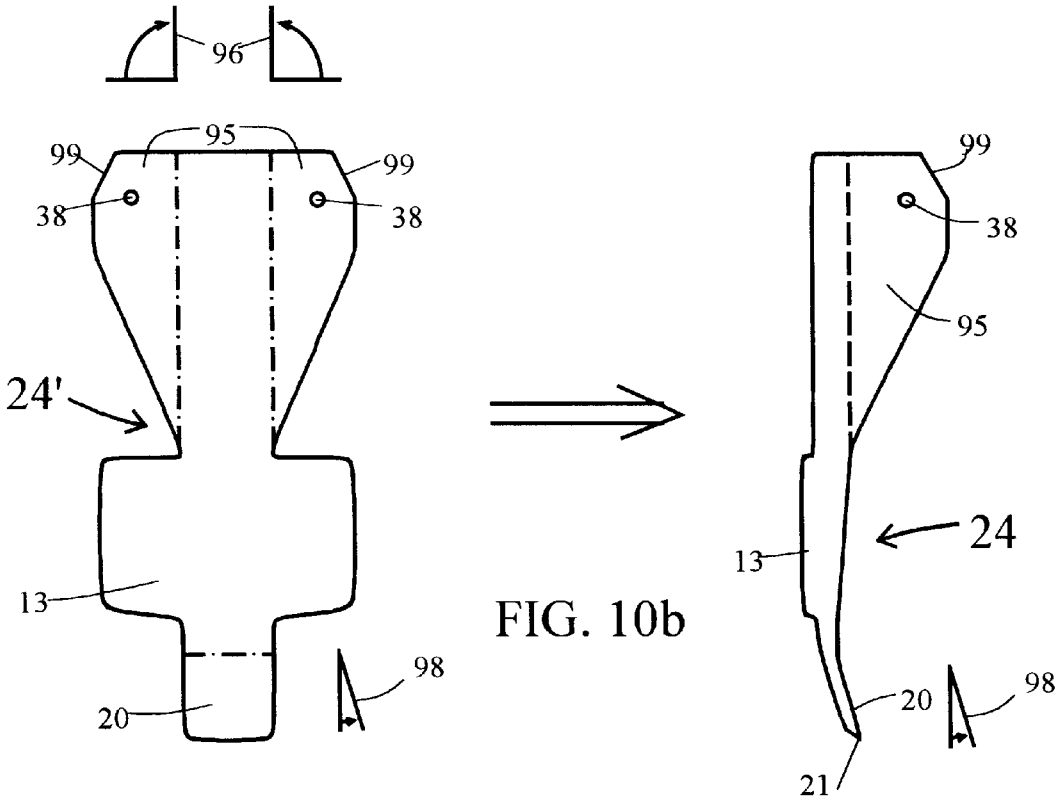
Figure 11A:
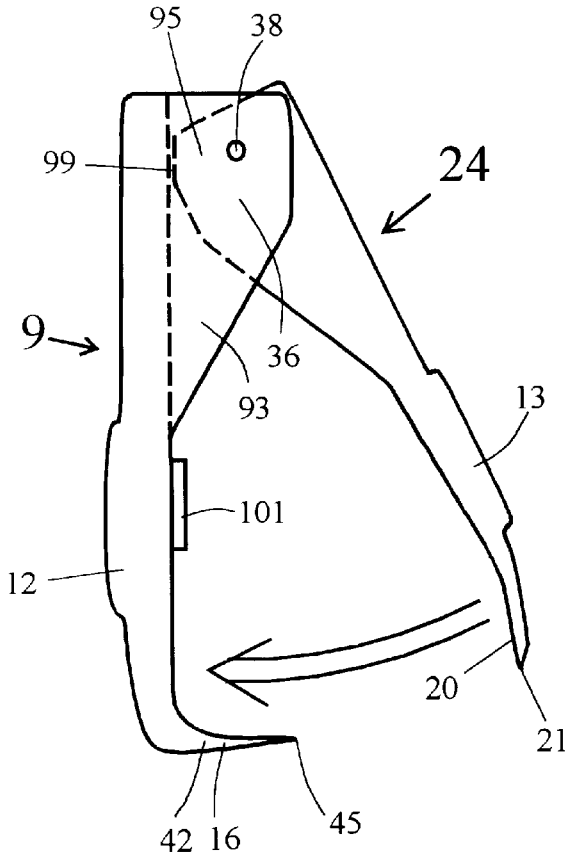
FIG. 11 is a side view of the fourth preferred, unibody embodiment of the invention.
Figure 11B:
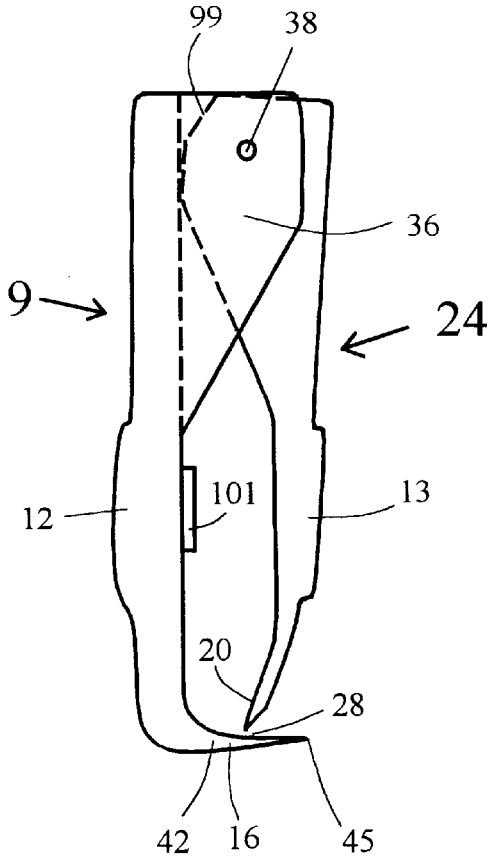

Referring to FIG. 1, there is illustrated a staple-remover device, in accordance with the first preferred embodiment of the present invention. The device includes a first arm 9 and a second arm 24, which are held together at one end by a pivoting means 26. The first arm includes gripping means 12 such as a series of depressions as shown in FIG. 1, or the gripping wings as shown in FIGS. 10 and 11, to facilitate gripping when the device is operated in a vertical position with the heel of the palm against the bottom of the second arm 24 and the fingers positioned in the gripping means+ 12 series of depressions. The second arm 24 may also include a complementary gripping means 13 such as a palm indentation, or complementary gripping wings as shown in FIGS. 10 and 11. The first arm 9 also includes a finger shield 10 such as the depicted finger guard, to protect the operator's ringers during use of the device.

Attached to an indentation 18 in the first arm 9 is a wedge-shaped piece 16. This piece is held tightly to the first arm 9 by means of a screw 14.

The second arm 24 is an elongated piece that may be unshaped or channel shaped in the transverse. Attached to an indentation in the second arm 24 is a plate 20 made of hard material such as metal, a flat edge 21 of which slightly exceeds the end of the second arm 24. This plate is held tightly in place by means of screws 22.

Figure 2:
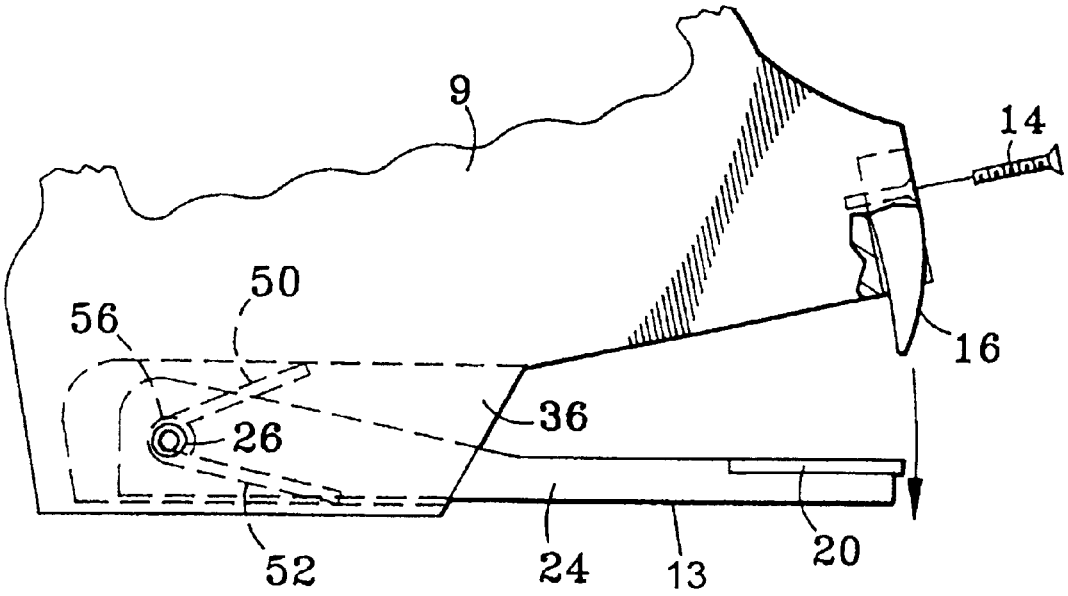
FIG. 2 is a side view of the first preferred embodiment with the arms in their natural open position.

Referring to FIG. 2, a side view of the staple remover is shown in accordance with the first preferred embodiment of the invention. This view depicts the staple remover in its natural or open position with the first arm 9 diverging from the second arm 24 at one end. In this position, the bias of the spring 56 as exerted through the second spring end 50 and the first spring end 52 holds the first arm 9 and the second arm 24 apart.

As depicted, second spring end 50 presses against the interior end surface of the female slot 36 of first arm 9. The first spring end 52 presses against the interior surface of the second arm 24. In this position the bottom surface of the female slot 36 of the first arm 9 is parallel to the second arm 24.

Figure 3:
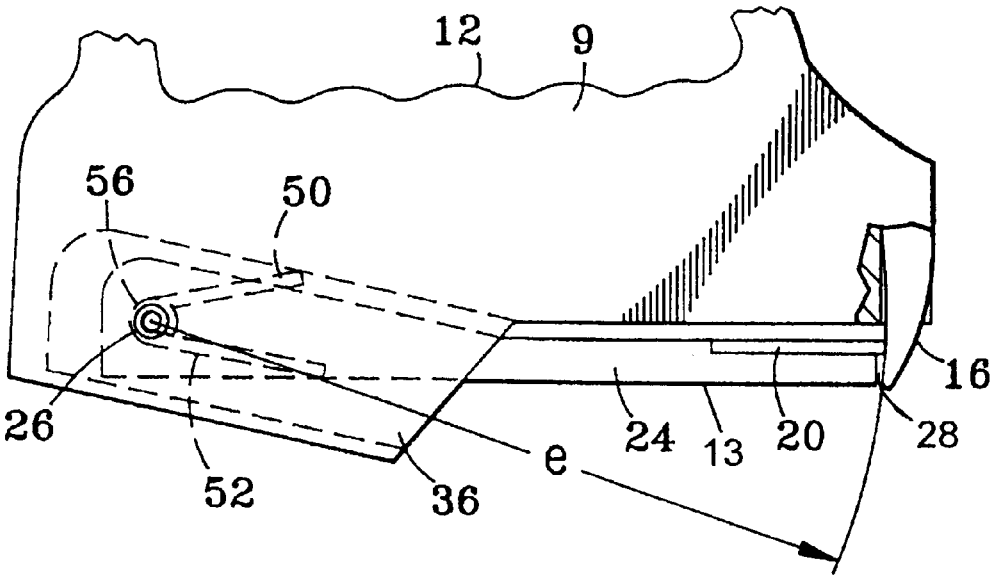
FIG. 3 is a side view of the first preferred embodiment with the arms closed to show the interaction of the wedge-shaped piece and the plate.

Referring to FIG. 3, a side view of the staple remover is shown, in accordance with the first preferred embodiment of the invention. This view depicts the first arm 9 as it appears when it has been squeezed against the second arm 24.

In this closed position, the wedge-shaped piece 16 abuts the plate 20. Furthermore, the female slot 36 of first arm 9 exerts pressure against the second spring end 50, thus decreasing the distance between the second spring end 50 and the first spring end 52. The spring 56 is also depicted, being held in place by the pivoting means 26.

The staple remover is typically operated in the vertical position as shown, with the heel of the user's palm pushing against the second arm 24, and the user's fingers utilizing the gripping means' 12 series of depressions to pull on the first arm 9.

Figure 4:
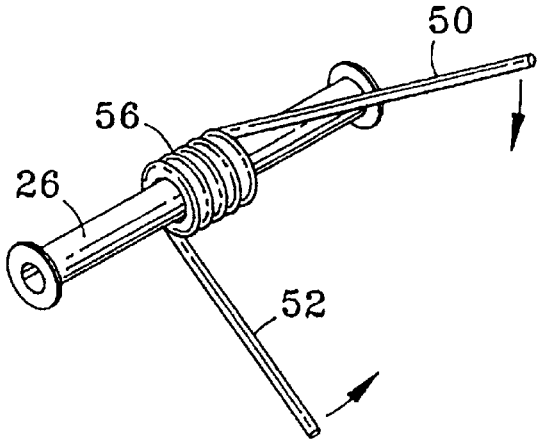
FIG. 4 is a depiction of the spring apparatus positioned around the pivot apparatus.

Referring to FIG. 4, the spring 56 is depicted. As shown, the spring is held in place by the pivoting means 26 which penetrates spring's 56 hollow center.

Figure 5:
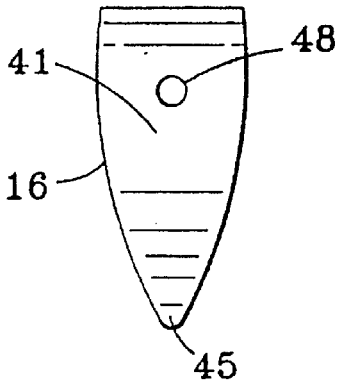
FIG. 5 is a front view of the first preferred embodiment of the wedge-shaped piece.
Figure 6:
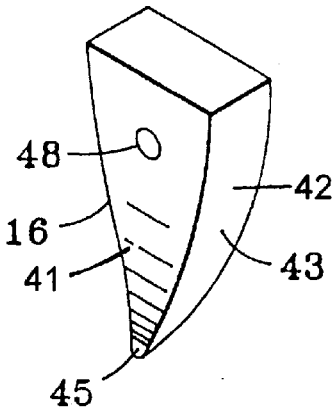
FIG. 6 is a back perspective view of the first preferred embodiment of the wedge-shaped piece.

Referring to FIGS. 5 and 6, the wedge-shaped piece 16 is depicted in accordance with the first preferred embodiment of the invention. This wedge-shaped piece 16 is substantially triangular in shape at one end, and rectangular in shape at the other end. The piece both widens and thickens from the tip 45 towards its central (removal) region, to a width and a thickness wherein the sum of the width plus twice the thickness at this central (removal) region 42 exceeds the total length of the three sides of the staple to be removed (which, for a standard staple, is 22 millimeters=12 millimeters (body)+5 millimeters (first leg)+5 millimeters (second leg)), and ensures that the staple legs will be gradually straightened (unfolded) and the staple will then fully and cleanly removed when the two arms of this device are pressed together as in FIG. 3. At this point, the wedge-shaped piece 16 becomes rectangular.

The front surface 41 of the wedge-shaped piece 16 curves down to the tip 45 on one side and is flat on the other. A hole 48 provides a means whereby the wedge-shaped piece 16 may be attached to the staple remover with a screw or other fastening device.

FIG. 6, depicts a perspective view of the wedge-shaped piece 16. The front surface 41 must be arced with the arc having a radius of curvature determined such that the origin of the arc coincides substantially with the position of said pivot point, and the wedge-shaped piece 16 widens and thickens from the tip toward its central (removal) region 42 as shown, with the thickening occurring on its rear surface opposite the front surface 43 (see also, FIG. 2). Thus, when the remover arms are pressed together as shown in FIG. 3, the plate will be perpendicular to a line tangent to the arc of the wedge-shaped piece at the point of closest proximity between the wedge-shaped piece 16 and the plate 20, and these pieces 16 and 20 will thereby maintain a small, substantially fixed distance 28 (less than the gauge thickness of a staple—see FIG. 3) from one another throughout the movement of the wedge-shaped piece 16 past the plate 20. This view also depicts a hole 48 for attachment.

Figure 7:
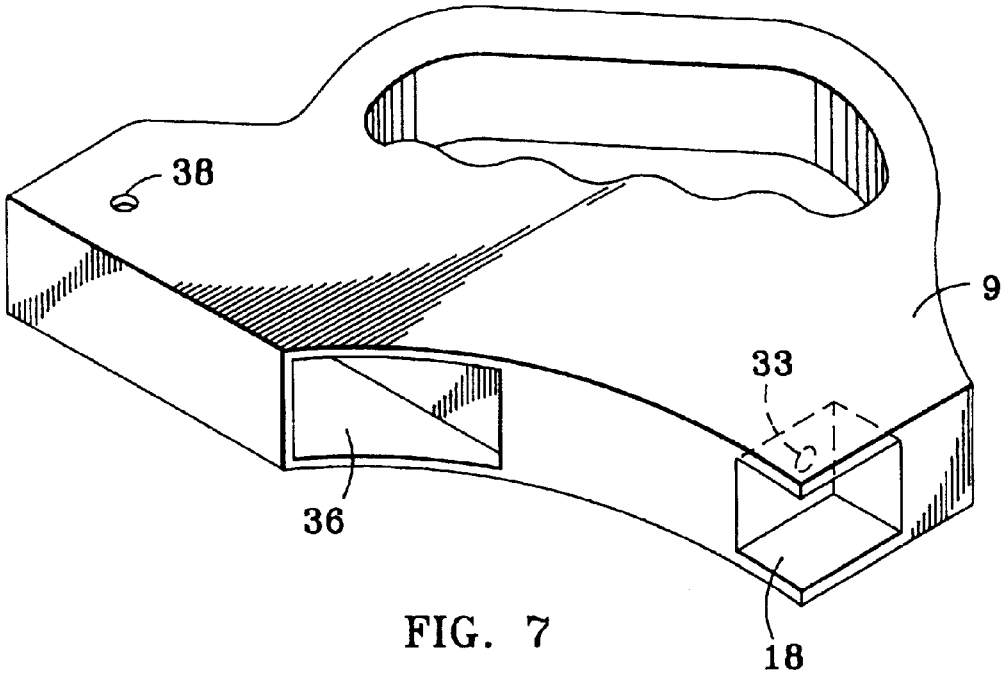
FIG. 7 is a perspective view of the top arm of the first preferred embodiment.

Referring to FIG. 7, a perspective view of the first arm 9 is shown in accordance with the first preferred embodiment of the invention. A female slot 36 is revealed whereby first leg 24 may be inserted and attached. This figure also depicts the indentation 18 to which the wedge-shaped piece 16 may be attached by means of a screw inserted into attachment hole 33. Two holes are also provided at a pivot point 38 on the back portion of the first arm 9 whereby a pivoting means 26 may be inserted.

Figure 8:
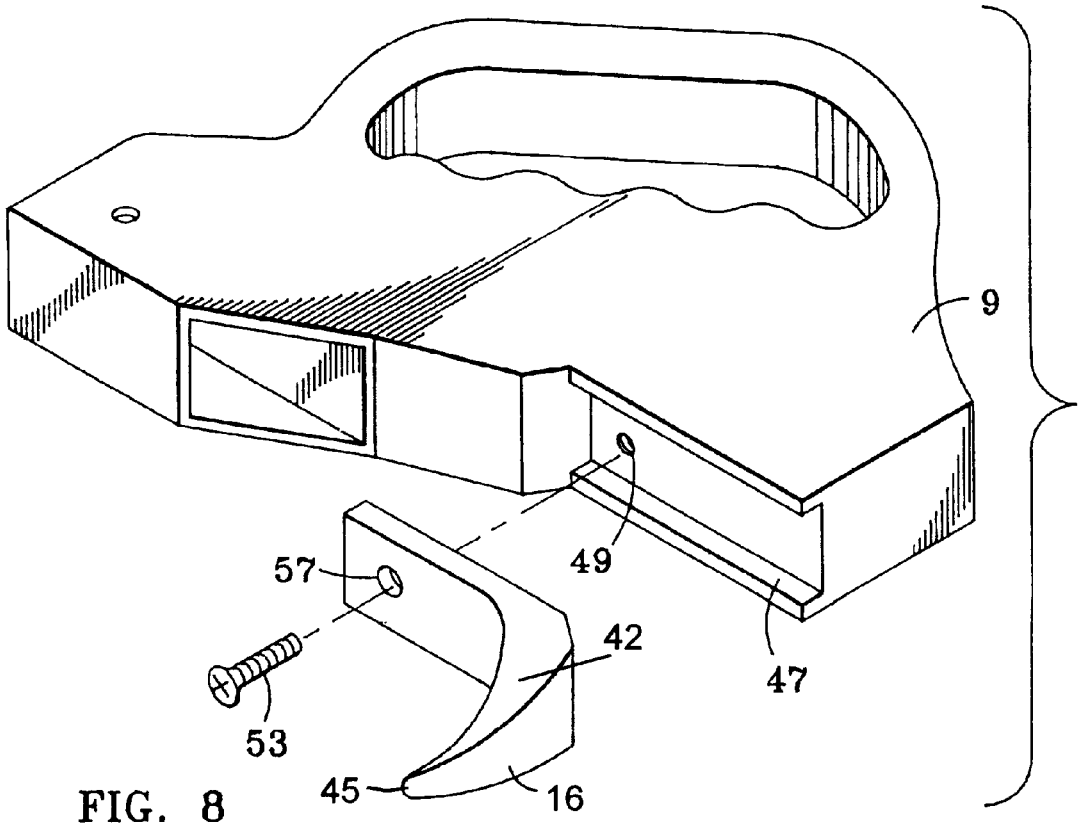
FIG. 8 is a perspective view of the top arm of the second preferred embodiment, and also depicts a perspective view of the second preferred embodiment of the wedge-shaped piece.

FIG. 8 discloses a second preferred embodiment of the present invention. In this embodiment, the wedge-shaped piece 16 is tapered and curved in a similar fashion to that in the first preferred embodiment. However, this embodiment includes an L-shaped curve at its central (removal) region 42 with a rectangular portion at its far end (the end most remote from the tip 45) as shown, and similarly to the first preferred embodiment (FIG. 5), widens and thickens from the tip 45 towards its central (removal) region 42. This piece is attached to the indentation 47 in the first arm 9 by inserting a screw 53 through hole 57 and into hole 49.

Figure 9:
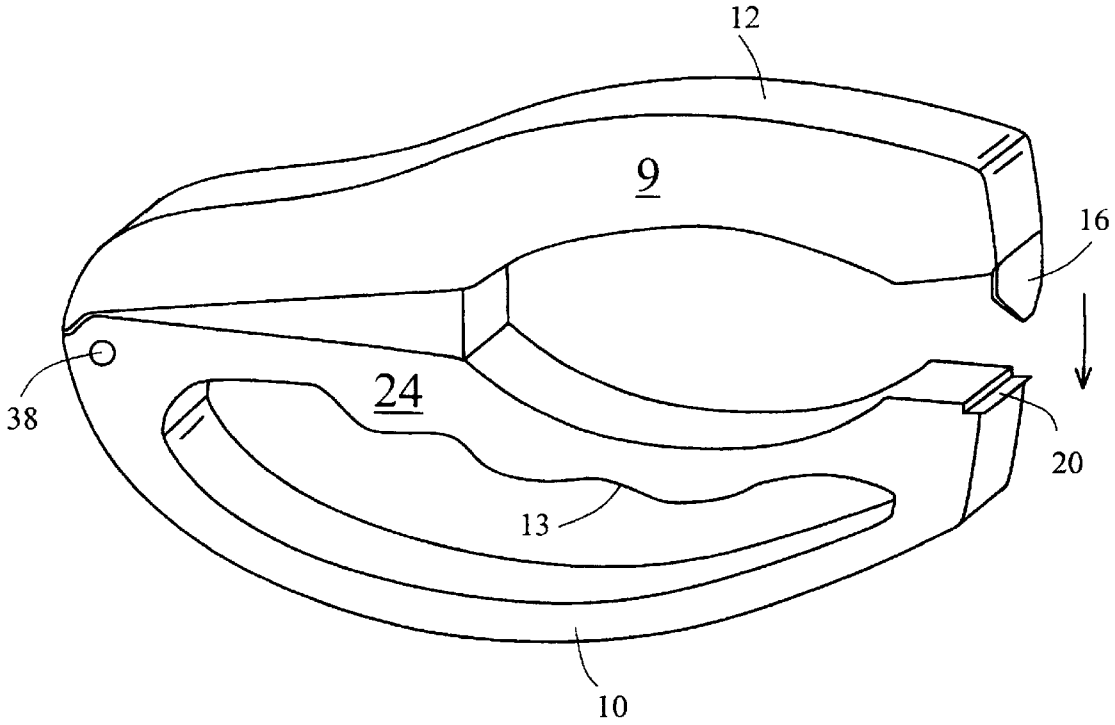
FIG. 9 is a perspective view of the third preferred embodiment of the invention.

FIG. 9 discloses a third preferred embodiment of the present invention. In this embodiment, the gripping means 12 on the first arm 9 is contoured as a palm grip, and the gripping means 13 on the second arm 24 is contoured as a finger grip, with a finger shield 10. Thus, when the palm is rested against 12 and the fingers against 13, the blade 16 in this embodiment points away from the user as it moves past the plate 20. The embodiments thus disclosed are not meant to be exhaustive, but rather illustrative of the range of possibilities for configuration, grips, etc.

The embodiments disclosed above utilize arms 9 and 24 that are manufactured separately from the wedge-shaped piece 16 and the plate 20. The wedge-shaped piece 16 and plate 20 are then screwed into the arms, see, e.g., the screws 14 and 22 in FIG. 1, and the screw 53 in FIG. 8. It may be desired, to eliminate the manufacturing step of screwing the wedge-shaped piece 16 and the plate 20 into the arms, and to reduce the number of distinct components involved, to manufacture the first arm 9 as a unitary piece with the wedge-shaped piece 16, and the second arm 24 as a unitary piece with the plate 20.

FIGS. 10 and 11 therefore, disclose a fourth preferred embodiment of the invention utilizing a unibody approach. The first arm 9 and second arm 24 are fabricated from a metallic or similar substance as illustrated in the left-most two drawings of FIG. 10. The material used for fabrication is a hard metal that can be pressed and bent under extremely-high pressure, but is otherwise rigid.

The first arm 9 is prefabricated into a first arm prefabrication piece 9' as shown in the upper left region of FIG. 10. A high-pressure molding and pressing process is then used to press this piece into the configuration depicted by the side view shown in the upper right region of FIG. 10. A variety of such molding and pressing processes are well-known in the art. In particular, the wedge-shaped piece 16 is bent downward at a substantially perpendicular angle 97, along the illustrated dash-dot line, so as to result in the configuration shown in the upper right section of FIG. 10, including the required arc, see, e.g, FIG. 6 and accompanying discussion. Similarly, a pair of first attachment members 93 are bent down at a substantially perpendicular angle 94, along the parallel dash-dot lines as shown, so as to also result in the configuration shown in the upper-right section of FIG. 10, which result in the creation of the female slot 36 used for later attaching the two arms together. The dotted line on the upper right drawing depicts the bottom face of the first arm 9, which, after fabrication, is hidden behind the first attachment members 93. Also depicted is the gripping means 12, which in this illustration, is embodied in a pair of gripping wings. The holes at the common pivot point 38 subsequently used to attach the first arm 9 and the second arm 24 together may either be punched into the first arm prefabrication piece 9' before the high-pressure process begins, or may be punched into this piece as part of the pressing process. Finally, note also that high temperatures, as necessary and suitable, may also be used as part of the fabrication (molding, pressing and bending) process. Also depicted on the first arm is a magnetic strip 101, which is used to attract and capture the staple once it is removed, thus averting the common nuisance whereby the staple, once removed, falls on the floor and must then be retrieved. Alternatively, one or both arms themselves, or sections thereof, may be magnetized so as to retain the staple once it is removed.

The second arm 24 is created in a similar way from a second arm prefabrication5Xpiece 24', into the configuration depicted by the side view shown in the lower-right region of FIG. 10. Here, the plate 20 is mildly bent to an angle 98 of approximately 15 degrees, along the illustrated dash-dot line, so as to result in the configuration shown in the lower right section of FIG. 10. Similarly, a pair of second attachment members 95 are bent down at a substantially perpendicular angle 96, along the parallel dash-dot lines as shown, so as to also result in the configuration shown in the lower right section of FIG. 10. The dotted line on the lower right drawing depicts the bottom face of the second arm 24, which, after fabrication, is hidden behind the second attachment members 95. Also depicted is the complementary gripping means 13, which in this illustration, is embodied in a pair of gripping wings. The holes at the common pivot point 38 subsequently used to attach the first arm 9 and the second arm 24 together, similarly, may either be punched into the second arm prefabrication piece 24' before the high-pressure process begins, or may be punched into this piece as part of the pressing process. Note also a pair of angled expansion stops 99, the function of which will be discussed shortly.

Once the first arm 9 and second arm 24 have been fabricated in this manner, they are attached together by sliding the second arm inside the female slot 36 of the first arm (the second arm is slightly less wide than the first arm for this reason, though this can of course be reversed within the scope of this invention), aligning the holes at the common pivot point 38, and using a pivoting means 26 and spring 56 as illustrated in FIG. 4, or any other similar method that may be obvious to someone of ordinary skill. The result of so attaching these arms 9 and 24 together is illustrated in FIG. 11. The net result is a staple remover operating on the same principle as the earlier embodiments, wherein the wedge-shaped piece 16 is arced with its focal point at the pivot point coinciding with the hole at the common pivot point 38, and the plate 20 moves past the wedge-shaped piece 16 so as to maintain a very small, substantially fixed distance, that is less than the gauge thickness of the staple being removed. Because the spring 56 tends to push the two arms apart (which is the natural position when the remover is not in use), the expansion stops 99 press against the bottom face of the first arm to stop expansion beyond the point depicted in the left side illustration of FIG. 11. Also depicted is the central (removal) region 42 which widens and thickens as one moves away from the tip 45, and the flat edge 21 of the plate, similarly to the earlier preferred embodiments disclosed.

Note that in the earlier embodiments, this plate 20 was unbent (i.e., the angle 98, FIG. 10, was zero degrees), so that it would be substantially perpendicular to a line tangent to the arc of the wedge-shaped piece 16 at the point of closest proximity between the wedge-shaped piece 16 and the plate 20. In FIGS. 10 and 11, this plate was bent to an angle 98 of fifteen (15) degrees. In fact, the plate may suitably be oriented with a bend of between zero (0) to thirty (30) degrees from the remainder of the second arm, which, after attachment of the first arm 9 and the second arm 14 as in FIG. 11, results in an angle between sixty (60) degrees and ninety (90) degrees, between the plate and said line tangent to the arc of the wedge-shaped piece 16. The fifteen (15) degree bend in FIG. 11 leaves a seventy five (75) degree angle between the place and said arc tangent line. What is most important, however, irrespective of the bend angle of the plate, is that the plate 20 be oriented in such a way that it will simply hold the staple in place as the wedge-shaped piece 16 unfolds and lifts the staple for removal, rather than itself help in any way to lift the staple. Thus, any angle which achieves this net result, is fully acceptable and encompassed by this disclosure and its associated claims.

It is also helpful to briefly discuss the range of possibilities for the gripping means 12 and complementary gripping means 13. For a larger staple remover wherein one arm is held against the palm of the hand and the other arm is held with the four fingers opposite the palm, wherein the fingers and palm are then pressed together to use the remover, one arm may conveniently include a series of indentations such as shown in connection with the gripping means 12 as illustrated in FIGS. 1, 2 and 3, and the other arm may conveniently include a variety of curvatures suitable to comfortable placement against the palm. Many grip arrangements providing comfortable use, e.g., that of FIG. 9, will be obvious to someone of ordinary skill, and are contemplated by this disclosure and its associated claims. The placement of the indentations used for a finger grip on the first arm as shown in FIGS. 1, 2 and 3, and of any curvature used for a palm grip on the second arm, will result in the wedge-shaped piece 16 being pointed toward the palm when the staple remover is used. Conversely, a reversal of these two grips between the two arms (or a reversal of the wedge-shaped piece 16 and the plate 20) will result in the wedge-shaped piece being pointed toward the fingers when this device is used. Either configuration is contemplated by this disclosure and its associated claims.

For a smaller staple remover wherein one arm is held against the thumb and the other arm is held against the index and middle fingers, wherein the thumb and said two fingers are pressed together to use the remover, the gripping means 12 and complementary gripping means 13 may comprise a pair of wings such as are commonly included on many commercially-available staple removers, as illustrated in FIGS. 10 and 11. However, the replacement of wings with finger and palm grips, or the use of any other grip configuration designed to facilitate comfortable use, is fully contemplated by this disclosure and its associated claims, and this disclosure and its associated claims are in no way limited to the specific gripping configurations illustrated herein.

Figure 12A:
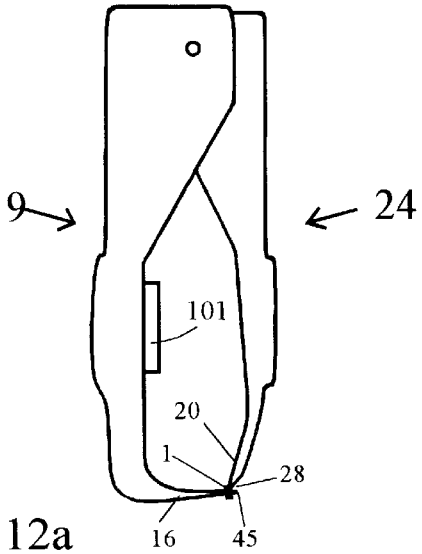
FIG. 12 illustrates the process by which all of the embodiments of the invention remove a staple.
Figure 12B:
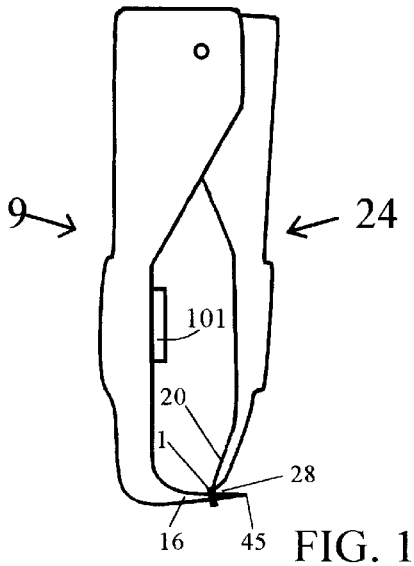
Figure 12C:
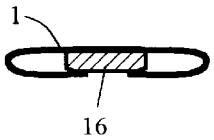
Figure 12C:
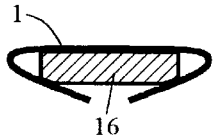
Figure 12C:
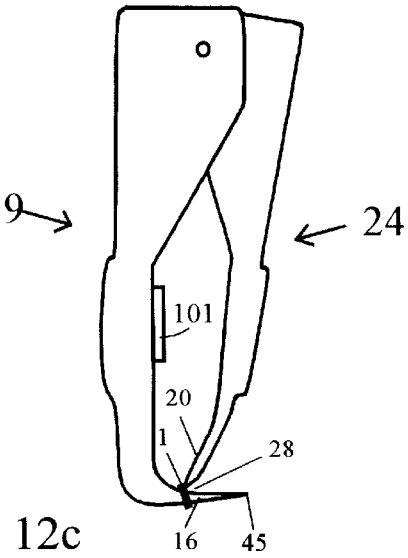
Figure 12D:
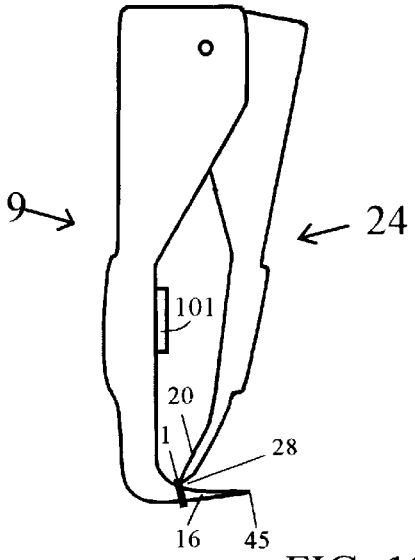
Figure 12:
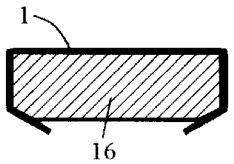
Figure 12:
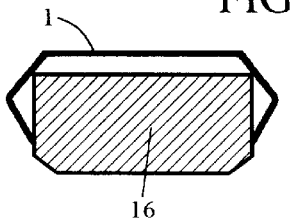

Finally, FIG. 12 illustrates the process through which a staple 1 is removed by pressing the arms 9 and 24 together with the staple in appropriate placement relative thereto. Although the fourth preferred embodiment of FIGS. 10 and 11 is used for this illustration, it is understood that this manner of removing the staple 1 applies to all other illustrated embodiments, as well as obvious variations to these embodiments.

Recall that the arc of the wedge-shaped piece 16 has a radius centered about the pivot point at which the two arms are attached so as to maintain a substantially constant distance 28 as these arms are pressed together, and that this distance 28 is smaller than the gauge thickness of the staple 1. FIG. 12 depicts, starting from the upper left and moving to the lower right, how the plate presses against the staple 1 without lifting it, so as to secure the staple while the wedge-shaped piece 16 is moved under the staple 1. Beneath each of the four main drawings comprising FIG. 12 is a cross-sectional view (shaded with diagonal lines) of the wedge-shaped piece 16 as it moves between the staple legs and the region of the staple connecting the two legs. As the arms are pressed further together, moving from upper left to lower right in FIG. 12, the gradual widening and thickening of the wedge-shaped piece first pushed the staple legs down, and then spreads them apart, while the thickening of the wedge-shaped piece 16 also provides lift without the user having to pull or lift at all on the staple. The only action provided by the user, is the pressing together of the arms 9 and 24. As can be seen, the plate 28 is used to hold the staple in place so that the wedge-shaped piece 16 can be slid under the staple and used to remove it, but the plate is not at all used for any lifting of the staple. The maintenance of a substantially constant distance 28 less than the staple gauge width, between the wedge-shaped piece 16 and the plate 28, ensures that the plate will properly secure the staple throughout removal. This provides a much cleaner removal than the prior art, in which two opposing pieces are typically both used to lift the staple.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

What is claimed is:

1. A device for removing staples of given width and leg length, comprising a wedge-shaped piece (16) and a plate (20), wherein:

said wedge-shaped piece (16) and said plate (20) pivot with respect to one another about a common pivot point (38); wherein a front surface (41) of said wedge-shaped piece (16) is curved in an arc with a radius of curvature determined such that the origin of the arc coincides substantially with the position of said pivot point (38); and wherein at a point of closest proximity between said wedge-shaped piece (16) and a flat edge (21) of said plate (20) when said wedge-shaped piece (16) and said plate (20) are pivoted together, said plate (20) is aligned at an angle (98) wherein said plate (20) holds a staple (1) in place for removal by said wedge-shaped piece (16) without said plate (20) lifting said staple (1); whereby said front surface (41) of said wedge-shaped piece (16) and said flat edge (21) of said plate (20) closest to said front surface (41) will remain at a small, substantially fixed distance (28) from one another as said wedge-shaped piece (16) and said plate (20) pivot past one another.

2. The device of claim 1, said wedge-shaped piece (16) having a tip (45) at one end, a second end, and a removal region (42) between said one end and said second end; wherein said wedge-shaped piece (16) varies in width such that it is narrowest at its tip (45) and becomes gradually wider toward its removal region (42); wherein said wedge-shaped piece (16) varies in thickness such that it is narrowest at its tip (45) and becomes gradually thicker toward its removal region (42); and wherein at said removal region (42), the sum of said width plus twice said thickness of said wedge-shaped piece (16) exceeds the total sum of the width plus twice the leg length of said staples which said device is to be used to remove.

3. The device of claim 1, further comprising:

a first arm (9), pivotally attached to a second arm (24) at said pivot point (38);

said first arm (9) including said wedge-shaped piece (16); and said second arm (24) including said plate (20).

4. The device of claim 3, said device being produced by a method wherein:

said first arm (9) is prefabricated into a first arm prefabrication piece (9'), said wedge-shaped piece (16) is bent downward from said first arm prefabrication piece (9') at a substantially perpendicular angle (97) to include said arc, and a pair of first attachment members (93) are bent downward from said first arm prefabrication piece (9') at a substantially perpendicular angle (94) to create a female slot (36), using a high-pressure molding and pressing process; wherein said second arm (24) is prefabricated into a second arm prefabrication piece (24'), said plate (20) is bent downward at said angle (98) from said second arm prefabrication piece (24') wherein said plate (20) holds a staple (1) in place for removal by said wedge-shaped piece (16) without said plate (20) lifting said staple (1), and a pair of second attachment members (95) are bent downward from said second arm prefabrication piece (24') at a substantially perpendicular angle (96), using a high-pressure molding and pressing process; and wherein said arms are attached by sliding said second arm (24) inside said female slot (36) of said first arm (9), aligning holes (38) in each arm, and then affixing said arms (9, 24) together.

5. The device of claim 4, wherein said second arm (24) is alternatively fabricated so as to include said female slot (36), and said first arm (9) is thereby alternatively slid inside said female slot (36) of said second arm (24).

6. The device of claim 4, wherein said molding and pressing processes further employ high temperatures.

7. The device of claim 5, wherein said molding and pressing processes further employ high temperatures.

8. The device of claim 1, wherein at said point of closest proximity, said plate (20) is aligned along a first plane differing by an angle (98) substantially between sixty and ninety degrees with respect to a second plane tangent to said front surface (41) of said wedge-shaped piece (16).

9. The device of claim 1, wherein at said point of closest proximity, said plate (20) is aligned along a first plane differing by an angle (98) of substantially seventy five degrees with respect to a second plane tangent to said front surface (41) of said wedge-shaped piece (16).

10. The device of claim 3, said first arm (9) further comprising gripping means (12).

11. The device of claim 3, said second arm (24) further comprising complementary gripping means (13).

12. The device of claim 3, further comprising a spring (56) biasing said first (9) and second (24) arms.

13. The device of claim 12, wherein said spring (56) is positioned inside said first arm (9).

14. The device of claim 12, wherein said spring (56) is positioned inside said second arm (24).

15. The device of claim 1, including a means (10) for shielding the user's fingers.

16. The device of claim 2, wherein at said removal region (42) of said wedge-shaped piece (16), the sum of said width of said wedge-shaped piece (16) plus twice the thickness of said wedge-shaped piece (16) exceeds 22 millimeters.

17. The device of claim 1, wherein said plate (20) is metallic.

18. The device of claim 1, wherein said plate (20) is composed of hard material.

19. The device of claim 1, wherein said wedge-shaped piece (16) is a solid, wedge-shaped blade.

20. The device of claim 3, wherein:

said first arm (9) further comprises a first end and a second end, and a female slot (36) proximate to said first end; wherein said second arm (24) further comprises a first end and a second end, said second arm (24) being pivotally attached to said first arm (9) at said pivot point (38), inside said female slot (36); and wherein said wedge-shaped piece (16) is proximate to said second end of said first arm (9) and said plate (20) is proximate to said second end of said second arm (24).

21. The device of claim 1, further comprising a magnet (101) to attract a staple (1) once said staple (1) is removed.

22. A method for removing staples of given width and leg length, comprising:

pivoting a wedge-shaped piece (16) and a plate (20) with respect to one another about a common pivot point (38); wherein a front surface (41) of said wedge-shaped piece (16) is curved in an arc with a radius of curvature determined such that the origin of the arc coincides substantially with the position of said pivot point (38); and wherein at a point of closest proximity between said wedge-shaped piece (16) and a flat edge (21) of said plate (20) when said wedge-shaped piece (16) and said plate (20) are pivoted together, said plate (20) is aligned at an angle (98) wherein said plate (20) holds a staple (1) in place for removal by said wedge-shaped piece (16) without said plate (20) lifting said staple (1); and wherein said front surface (41) of said wedge-shaped piece (16) remains radially further from said pivot point (38) than said flat edge (21) of said plate (20) closest to said front surface (41) by a small, substantially fixed radial distance (28), as said wedge-shaped piece (16) and said plate (20) pivot past one another.

23. The method of claim 22, said wedge-shaped piece (16) having a tip (45) at one end, a second end, and a removal region (42) between said one end and said second end; wherein said wedge-shaped piece (16) varies in width such that it is narrowest at its tip (45) and becomes gradually wider toward its removal region (42); wherein said wedge-shaped piece (16) varies in thickness such that it is narrowest at its tip (45) and becomes gradually thicker toward its removal region (42); and wherein at said removal region (42), the sum of said width plus twice said thickness of said wedge-shaped piece (16) exceeds the total sum of the width plus twice the leg length of said staples which said device is to be used to remove.

24. A device for removing staples wherein a staple (1) to be removed is held in place by a plate (20), while a wedge-shaped piece (16) remaining radially further from a common pivot point (38) than a flat edge (21) of said plate (20) by a small, substantially fixed radial distance (28) is slid between legs and a body of said staple (1) and used to unfold and separate said legs of said staple (1), and lift said staple (1).

25. A method for removing staples, comprising holding a staple (1) to be removed in place by a plate (20), while sliding a wedge-shaped piece (16) remaining radially further from a common pivot point (38) than a flat edge (21) of said plate (20) by a small, substantially fixed radial distance (28) between legs and a body of said staple (1), thereby unfolding and separating said legs of said staple (1), and lifting said staple (1).

* * * * *